US005431300A

United States Patent [19]

Kahanek et al.

[11] Patent Number: 5,431,300

[45] Date of Patent: Jul. 11, 1995

[54] SINGLE VEND DEVICE FOR A NEWSPAPER VENDING MACHINE

[75] Inventors: Alan P. Kahanek, Yoakum; Ralph J. Ullmann, Shiner, both of Tex.

[73] Assignee: Kaspar Wire Works, Inc., Shiner, Tex.

[21] Appl. No.: 241,742

[22] Filed: May 12, 1994

Related U.S. Application Data

[63] Continuation-in-part of Ser. No. 927,157, Aug. 7, 1992, Pat. No. 5,318,195, which is a continuation-in-part of Ser. No. 775,616, Oct. 15, 1991, Pat. No. 5,143,251.

[51] Int. Cl.[6] ..... B65H 3/00

[52] U.S. Cl. ..... 221/151; 221/154; 221/155

[58] Field of Search ..... 221/151, 152, 154, 155

[56] References Cited

U.S. PATENT DOCUMENTS

| | | | |
|---|---|---|---|
| 3,747,733 | 7/1973 | Knickerbocker | 194/10 |
| 3,912,124 | 10/1975 | Pinkerton | 221/298 |
| 4,067,477 | 1/1978 | Chalabian | 221/1 |
| 4,093,058 | 6/1978 | Terry | 194/71 |
| 4,140,242 | 2/1979 | Muller et al. | 221/154 |
| 4,174,047 | 11/1979 | Owens | 221/154 |
| 4,258,861 | 3/1981 | Traill et al. | 221/213 |
| 4,375,844 | 3/1983 | Facto | 194/54 |
| 4,377,228 | 3/1983 | Ostermann | 194/54 |
| 4,393,970 | 7/1983 | Strack, Jr. | 194/17 |
| 4,465,207 | 8/1984 | Chalabian | 221/241 |
| 4,530,444 | 7/1985 | Christian | 221/37 |
| 4,654,513 | 3/1987 | Hennessy | 235/381 |
| 4,865,178 | 9/1989 | Lewandowski | 194/227 |
| 4,981,236 | 1/1991 | Riedle et al. | 221/151 X |
| 5,143,251 | 9/1992 | Kahanek et al. | 221/152 |
| 5,318,195 | 6/1994 | Kahanek et al. | 221/152 |

*Primary Examiner*—David H. Bollinger
*Attorney, Agent, or Firm*—Gunn, Lee & Miller

[57] ABSTRACT

The application discloses a device (10) to retrofit into the cabinet (11) of newspaper vending machine racks to prevent the removal of more than one copy of the newspaper for each vend or door opening of the cabinet (11). The single vend device (10) consists of a front panel (12) with a T-slot (14). The arms (14*a*) of the T-slot (14) are normally closed off with a pivoted closure plate (16). Consumer access to the newspapers is provided through the leg of the T-slot (14*b*), but the newspaper must be slid through the gap between the closure plate (16) and the front panel (12). The thickness of the gap is adjustable to selectively allow for the variation in thickness between various editions of the newspaper. The closure plate (16) is spring loaded to be biased to the closed position. Following removal of the paper, the closure of the plate (16) and a locking pin (32) prevents the plate (16) from re-opening. The locking pin (32) is disarmed upon closure of the cabinet (11) door (25*a*).

7 Claims, 11 Drawing Sheets

SINGLE VEND DEVICE FOR A NEWSPAPER VENDING MACHINE

This is a Continuation-in-Part of application U.S. Ser. No. 07/927,157 filed on Aug. 7, 1992, now U.S. Pat. No. 5,318,195, which in turn, is a continuation-in-part of U.S. Ser. No. 07/775,616 filed on Oct. 15, 1991, now U.S. Pat. No. 5,143,251.

FIELD OF THE INVENTION

This invention relates to an anti-theft device for newspaper vending machines, more particularly to an anti-theft device with a closure plate engaged and disengaged and disengaged through a cable operated locking means, which is in turn actuated through movement of the door of the newspaper cabinet.

BACKGROUND OF THE INVENTION

Newspaper vending machines are an increasingly popular way of distributing newspapers throughout the country. Frequently, newspaper vending machines act on a honor system. That is, a consumer will insert the required amount of coinage into the coin mechanism of the newspaper vending machine which will then allow the consumer access to the newspaper containing cabinet of the vending machine through a manually-operated door. The door, being unlocked upon the insertion of the required amount of coinage, usually allows the consumer access to all of the newspapers. The dishonest consumer will take more than one edition of the newspaper. This is especially true when publishers, especially those in highly competitive metropolitan markets, offer a "game card," coupons, promotional inserts and the like with each edition. The dishonest consumer may take all of the editions, or at least more than the one purchased edition, in order to gain access to the game cards or coupons and increase his chances of winning a prize.

Thus, what is needed in the industry is a simple device to deter the theft of more than one newspaper with the device being capable of being retrofitted into the cabinets of existing newspaper vending machines.

The prior art discloses a number of devices designed to prevent the withdrawal of more than a single addition of a newspaper from the cabinet of a newspaper vending machine.

One such device is disclosed in U.S. Pat. No. 4,496,074 (Owens 1985). Owens discloses a vending machine for newspapers designed to prevent the theft of periodicals by dishonest customers. The device of Owens can be installed in existing vending cabinets. Owens device is capable of dispensing newspapers of widely varying thickness to the use of an elliptical newspaper release roller (39). This roller depresses and buckles the top most paper of the stack to effect its release. However, retrofitting the Owens device into an existing cabinet (such as assignee's popular "K-80") would require extensive machining of the cabinet and replacing the existing elevator mechanism of the "K-80."

U.S. Pat. No. 4,651,896 (Harold 1987) discloses another machine for vending newspapers of varying thicknesses. The Harold device provides for a normally closed barrier member self-adjusting to the thickness of various newspapers and controlled by ratchet mechanisms such that upon withdrawal of the newspaper, the blocking mechanism is reset to lock in its closed position. The Harold device, however, is not retrofittable into an existing newspaper cabinet such as the K-80, and is mechanically rather complicated.

U.S. Pat. No. 3,905,503 (Emmel 1975) discloses a newspaper vending machine to prevent the theft of newspapers utilizing a gate mounted so as to oscillate between a closed and open position, the open position allowing the removal of the top paper of the newspaper stack. The Emmel device is not easily retrofittable into existing newspaper cabinets such as the K-80.

U.S. Pat. No. 3,747,733 (Knickerbocker 1973) provides for a newspaper periodical dispensing machine. The Knickerbocker device allows for the displayed paper in the window of the cabinet to be secure until the last newspaper is withdrawn from the storage compartment. When the last newspaper is withdrawn from the storage cabinet, the Knickerbocker device unlatches the display case access door to allow the consumer to remove the display copy of the newspaper from the display case. The Knickerbocker device provides for dispensing of the top newspaper in the storage compartment when the access door is swung open. When the top newspaper is removed from the cabinet, all remaining newspapers are locked in a storage compartment. The Knickerbocker device, however, is not easily retrofittable into existing newspaper cabinets, such as the K-80, without extensive modifications thereto.

U.S. Pat. No. 4,981,236 (Riedle 1991) discloses an anti-theft device for use in a coin operated dispensing machine which is designed to be retrofittable into the K-80 cabinet manufactured by assignee of the present invention. The Riedle apparatus includes a cover panel assembly (17), cover panel mounting bracket (18), and a reset mounting tab (19). However, the use of the Riedle device is needlessly complex, especially in the manner of retrofitting which requires the use of tools and extensive machining to modify the present cabinet of the K-80 by mounting, such as with bolts or the like, a reset mounting bracket to the inside door of the K-80, as well as mounting a cover panel mounting bracket (18) (see Riedle, FIG. 5) before the K-80 can accommodate the cover panel assembly.

Applicants' device solves a need for a less complex device by providing for a device to retrofit into the cabinets of newspaper vending machine racks to prevent the removal of more than one copy of the newspaper for each vend or door opening of the cabinet. The single vend device consists of a front panel with a T- or Y-shaped slot. The generally horizontal arms of the slot are normally closed off with a pivoted closure plate.

Consumer access to the newspapers is provided through the vertical leg of the slot, but the newspaper must be slid horizontally through the discharge gap between the closure plate and the front panel. The thickness of the gap is adjustable to selectively allow for the variation in thickness between various editions of the newspaper. The closure plate is spring loaded to be biased to the closed position. Following removal of the paper and the closure of the plate, a locking pin prevents the plate from pivoting to a release position until the cabinet door is closed. The locking pin is disarmed upon closure of the cabinet door.

It is a purpose of this invention to provide for a single vend device for easily (without tools) retrofitting newspaper vending machines that will help deter the theft of more than one issue of the newspaper by providing an adjustable width closure plate and an access slot, with resettable means for locking the normally biased closure plate in a locked position following the removal of single edition through the access slot.

A third alternate, preferred embodiment of applicants' invention provides a single vend device having a front panel with a T- or Y-shaped slot, the horizontal arms the slot normally obstructed by a pivoting closure plate, which is locked and unlocked through a cable attached to a door engagement member in such a way that as the door is moved, the door engagement member acting through a cable unlocks the closure plate and allows access to the papers through the slot in the front panel.

Still another alternate, preferred embodiment of applicants' present invention provides a simplified shape to the front panel such that the single vend device may be rotated into the newspaper cabinet opening and locked without modifying the cabinet in any way and without the use of spring-loaded tensioning devices heretofore necessary to maintain the panel in the cabinet.

Yet another alternate preferred embodiment of applicants' present invention provides a means to resettably lock the closure plate in a closed position comprising a mounting plate with a sliding locking prong mounted thereto and a moving plate having walls defining a channel, the moving plate being actuated by the closure plate and a trip lever for locking the locking prong in either a immovable position with the trip lever engaging the locking prong or a movable position with a trip lever out of engagement with the locking prong.

The alternate preferred embodiments of applicants' present invention described hereinabove which, when compared to those devices previously available, provide a number of advantages. First, the single vend device is easily placed into a newspaper cabinet or removed therefrom by the vendor without the necessity of using hand or power tools to modify the cabinet and without any clumsy spring-loaded tensioning devices. Second, the single vend device utilizes a cable for engaging the resettable closure plate locking means. The use of the cable avoids problems heretofore encountered with previous single vend devices which required sometimes delicate adjustments of the member engaging the door of the newspaper vending cabinet. Further, applicants' use of a cable rather than a metal rod takes some of the "bounce" out of the system when the doors of the newspaper rack is slammed shut. Applicants have found the cable actuated closure plate resettable locking means to be superior also in that they typically do not need to be set for adjustment in the field by vendors installing the device into newspaper cabinets for the first time. Last, advantages of applicants' present trip lever and prong operated resettable locking means provides an efficient, easy to manufacture, durable and long-lasting easy to operate single vend device.

SUMMARY OF THE INVENTION

This invention provides an anti-theft device for newspaper vending machines having a cabinet for substantially enclosing newspapers, an elevator shelf onto which the newspapers are stacked, which elevator shelf raises as newspapers are removed from the top of the stack, a manually-operated, hingedly-attached door to provide access to the interior of the cabinet, a means for lockingly engaging the door, and a coin-control mechanism to engage and disengage a locking means. More specifically, the anti-theft device of the present invention comprises a front panel with a front and a rear surface, for substantially blocking access to the newspaper stack, the front panel having a perimeter thereon dimensioned to removably engage the cabinet of the newspaper vending machine, the front panel with walls defining a "T-shaped" or "Y-shaped" opening, the generally horizontal arms of the opening being of sufficient width to extract a newspaper width-wise therefrom, the generally vertical leg of the opening being substantially less than the width of a newspaper; key operative locking means engageable with the perimeter of said front panel to lock said front plate to the walls of the cabinet; a mounting panel with a top and a bottom surface integral with said front panel located above the T-shaped opening of said front plate, said mounting base projecting substantially perpendicular from the rear surface of said front panel; a closure plate pivotally mounted to the rear surface of said front plate above the T-shaped opening and below said mounting base, the closure plate dimensioned to substantially cover the arms of the T-shaped opening, the closure plate having a flat portion and a bent portion, said closure plate with a leading edge defining the edge between the two portions, said closure plate for moving between a closed position, the closed position with the leading edge flush against the lower edge of the rear surface of the walls defining the arms of the T-shaped opening, the closed position substantially preventing access to the newspapers and an open position, said open position reached by rotation of said closure plate from the closed position until the leading edge of said closure plate is at a position removed from the walls defining the lower edge of the T-shaped opening, the open position defining an access width through which the newspaper is removed from the interior of the cabinet; a sheet slidably mounted to and flush with the bottom surface of said mounting base, the sheet operatively engaged with the rear surface of the closure plate such that movement of the closure plate towards an open position causes the sheet to slide away from said panel and across the bottom surface of said mounting base; means to adjust the access width, said means comprising walls defining a line of adjustment holes through said mounting plate, a pin dimensioned to engage the adjustment holes, and pin retainment means slidably mounted in alignment with the adjustment holes, the width adjustment means further comprising an edge of said slidably mounted plate, the edge in acute angular relationship to the line of adjustment holes; means biasing said closure plate towards the closed position; means to resettably lock the closure plate in the closed position, said closure plate lock means comprising an arm means, a pin means, and a reset means, the arm means coupled to the door of the newspaper cabinet, the arm means to raise the pin out of a hole in said sliding sheet, the hole aligned with said pin for receipt of the pin therethrough, when said closure plate is the first position, the pin released from its raised position by resent means upon movement of the closure plate from its first position, thereby allowing pin to re-engage the hole upon return of said plate to the first position.

DETAILED DESCRIPTION OF THE PREFERRED EMBODIMENT

Figure 1:
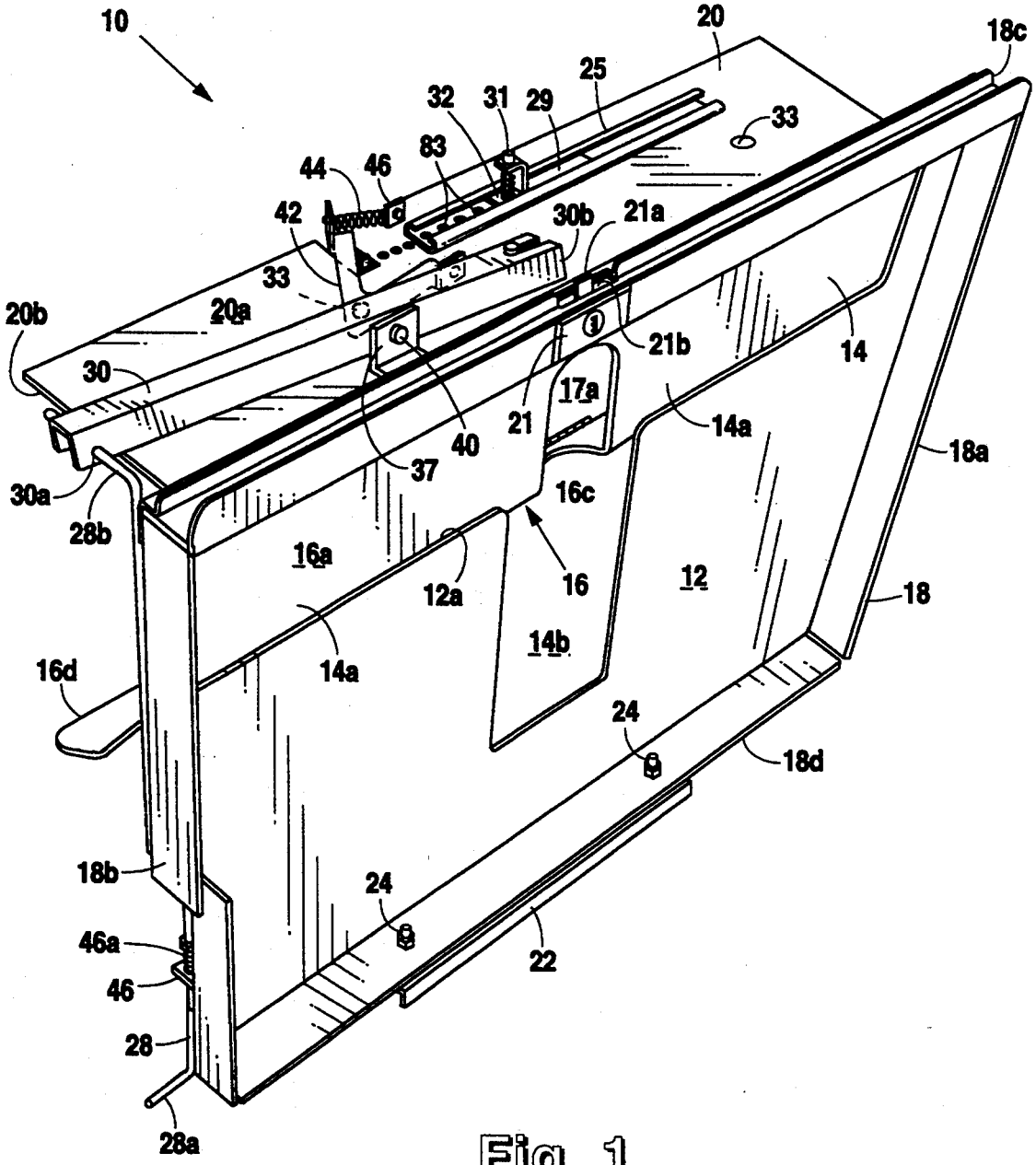
FIG. 1 is a prospective view showing the front of the theft deterrent device.
Figure 2:
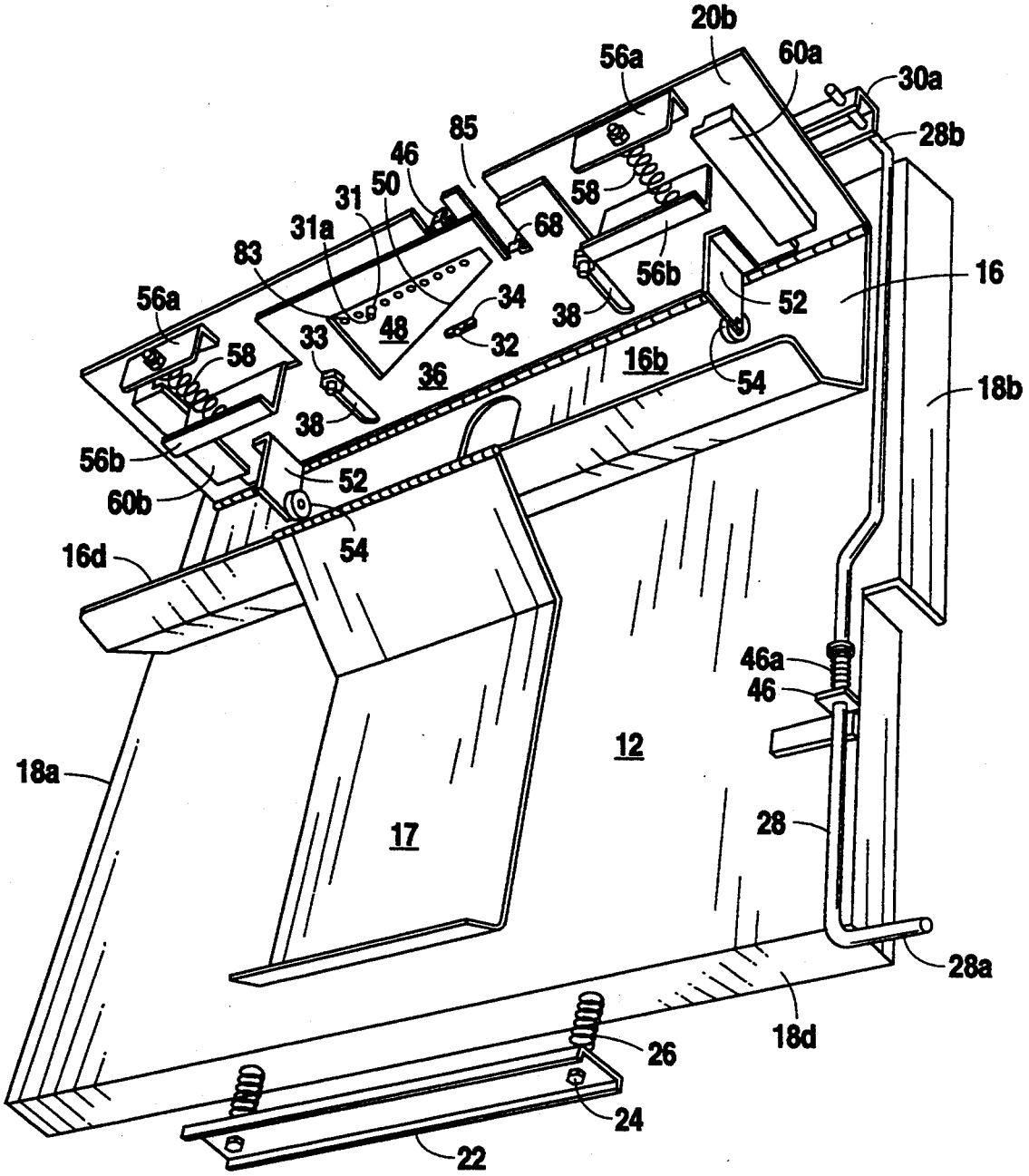
FIG. 2 is a prospective view showing the rear of the theft deterrent device
Figure 3:
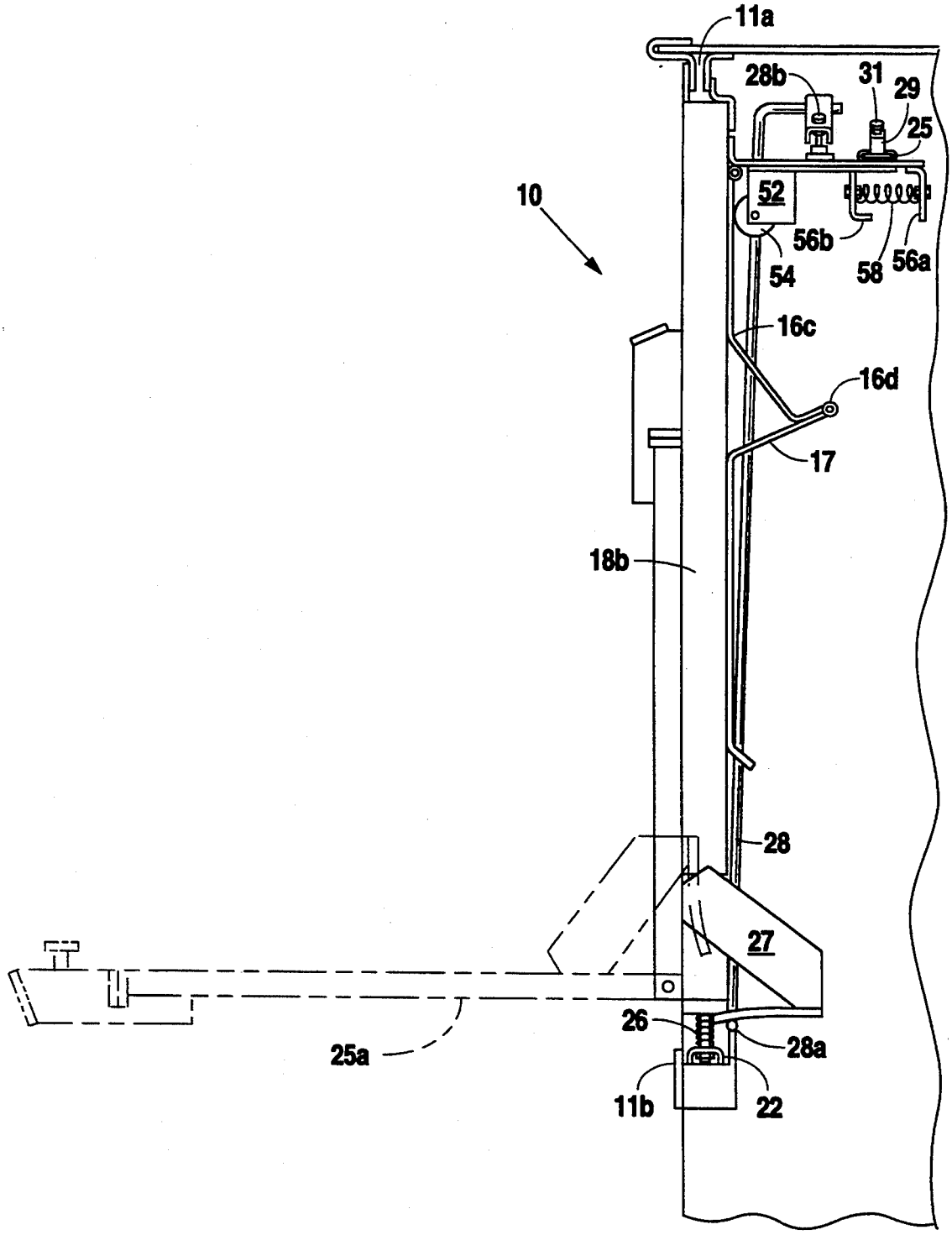
FIG. 3 is a side elevational view of the theft deterrent device.

With reference to FIGS. 1, 2, and 3 it can seen that the theft deterrent device (single vend device) (10) of the present invention is adapted to fit into a cabinet (11) and comprises a front panel (12) with a T- or Y-shaped opening (14) therein (hereinafter, reference to T-shaped will be understood to mean Y-shaped also). As it is further evidenced from FIG. 1, the T-shaped slot is dimensioned with arms (14*a*) extending generally transverse to leg (14*b*). Front panel (12) has a top edge (12*a*) defining the lower border of arms (14*a*). Access through arms (14*a*) of T-shaped opening (also called "access slot") (14) is controlled by means of a pivotally mounted closure plate (16) having a front surface (16*a*) and a rear surface (16*b*). Closure plate (16) is generally "J" shaped and has leading edge (16*c*) and trailing edge (16*d*). Cut-out (17*a*) in closure plate (16), in conjunction with leg (14*b*) in front panel (12), provides a means for the consumer to reach the newspapers. The newspaper stack (not shown) generally rests on an elevated, upwardly biased shelf which will urge the stack upward toward trailing edge (16*d*) as papers are removed. As can be seen in FIG. 1, leading edge (16*c*) lies across and just below top edge (12*a*) of the front panel when closure plate (16) is in its normally biased, closed position as represented in FIG. 1. Tail (17) is pivotally mounted centrally along trailing edge (16*d*) to hang freely therefrom. This helps keep the papers in the stack from curling up.

Turning back to front panel (12), it may be seen that perimeter (18) is integral therewith. More particularly, perimeter (18) is comprised of right side (18*a*) and left side (18*b*), top edge (18*c*) and lower (18*d*). Further, from viewing FIGS. 1, 2, and 3, it can be appreciated that perimeter (18) is dimensioned to be received within the front opening of cabinet (11) of the newspaper vending machine. More particularly, FIG. 3 illustrates the manner in which lips (11*a*) and (11*b*) of cabinet (11) engage the groove defining top edge (18*c*) and channel (22) to retain single vend device (10) to cabinet (11).

Pausing for a moment, to discuss the function of the above cited structure, it can be appreciated that front panel (12) substantially prevents access to newspapers within the cabinet of the newspaper rack when the panel is affixed thereto. More particularly, it can be appreciated that access to the newspapers is limited to the hand of the consumer reaching through leg (14*b*) to slide the paper on top of the stack "up and out" the access slot (14) as the closure plate (16) pivots away, producing a gap between top edge (12*a*) and leading edge (16*c*). With closure plate (16) biased in a normally closed position, the removal of the newspaper through arms (14*a*) of the slot will allow closure plate (16) to resume its normally closed position.

Examining now, the details of FIGS. 1 and 2, it can be seen that front panel (12) has attached to the rear surface thereof top or mounting plate (20) to which it is attached a myriad of various structures, the details of which will be examined below. Along lower edge (18*d*) is mounted channel (22) on attachment means (24) with springs (26) to bias channel (22) to a position removed from lower edge (18*d*). At top edge (18*c*) it can be seen that there is a similarly dimensioned channel. Also along top edge (18*c*) can be found key member (21) to lock theft determent device (10) into the cabinet of the newspaper vending machine. Blade (21*a*) is normally recessed into slot (21*b*) along top edge of perimeter (18*c*) for insertion and removal of single vend device (10) into cabinet (11). However, once single vend device (10) is inserted into channels (11*a*) and (11*b*) and key member (21) operated, blade (21*a*) is pivoted from its recessed position to project vertically upward and behind lip (11*a*), single vend device (10) is locked into the cabinet (11). Key member (21) allows the anti-theft device (10) of the present invention to be locked within the cabinet of the newspaper vending machine by providing blade (21*a*) to rotatably and lockingly engage the upper lip of the cabinet interior.

Functionally, the devices described in the preceding paragraph will allow the anti-theft device to be lockingly inserted into upper and lower members of walls defining the interior of a standard sized newspaper vending machine cabinet. Such cabinets are well known in the art. An example of one such cabinet is the SHO-RACK ® by Kaspar Wire Works, Inc. of Shiner, Tex., Assignee of the present invention. The anti-theft device (10) as disclosed here is, in fact, dimensionally and structurally suited for insertion into the SHO-RACK ® models number K-80 and TK-80. Both of these models have the elevator shelf rack that will provide for a stack of newspapers to be urged upwards so that the removal of the top edition will allow the stack to move upward so as to continue to provide a stack within reach through cutout (17*a*) and leg (14*b*), but not above trailing edge (16*d*).

Having described now, the general features of front panel (12), T-shaped slot (14) and closure plate (16), we turn now to the varied structure that is located on or about top plate (20). References made to FIGS. 1 and 2 for the following discussion with FIGS. 3, 4, 5, and 6 more particularly describing subcomponents of the devices. As appreciated from the foregoing discussion, it is important that closure plate (16) be locked in the closed position as illustrated in FIG. 1 following the removal of the single purchased edition of a newspaper through T-shaped opening (14). If not, the dishonest consumer could just continue to remove newspapers. Locking pin (32), in engagement with the following structure, achieves such a function. More particularly, actuator engagement arm (28) riding on guide (46) and biased upward by spring (46*a*) engages actuator member (27) of door (25*a*) of the newspaper rack at engagement finger (28*a*), each time door (25*a*) is closed, as seen in FIG. 3. At the removed end of actuator engagement arm (28*b*) and pivoting thereon is pin engagement arm (30). Engagement arm (30) is bias by the influence of the spring (46*a*) to a normally "up" position. Pin engagement arm (30) is pivoted at pivot (40) located on "L-shaped" bracket (37) mounted to the top plate (20).

Pausing momentarily to discuss the function of the locking pin system, it can be seen that the opening and closing of door (25*a*) will raise and lower locking pin (32) through the action of actuator member (27) on arms (28) and (30).

Turning now to FIG. 2 it can be seen that bottom surface (20*b*) of top plate (20) contains a sliding plate (36) flushly mounted and riding thereon. Sliding plate (36) contains many features which are discussed in more detail as follows. Attention is now turned to locking pin (32) which when viewed from the underside of the anti-theft device as illustrated in FIG. 2 can be seen to project through hole (34) in sliding plate (36). In the position as illustrated in FIG. 2 closure plate (16) is locked in the closed position. In this position, it can be appreciated that if locking pin (32) projects through hole (34), sliding plate (36) cannot slide rearward, as will be required to open closure plate (16) and allow access to the newspapers. It can also be appreciated from a look at FIG. 1, that when engagement finger (28*a*) is pressed downward and attachment end (30*a*) of pin engagement arm (30) is lowered, slot end (30*b*) of pin engagement arm (30) will raise locking pin (32). In a raised position, locking pin (32) will allow sliding plate (36) to slide across bottom surface of (20*b*). Thus, the raising and lowering of locking pin (32) into and out of hole (34) of sliding plate (36) will control the ability of closure plate (16) to pivot to an open position.

Turning now to more detail of the unique sliding plate (36) it can be seen that sliding plate (36) rides along bottom surface (20*b*) on paired slotted guides (38) and bolts (33). This bolt and guide system acts in conjunction with lateral guide means (60*a*) and (60*b*) to prevent side-to-side movement and limit the movement of sliding plate (36) to the "fore-and-aft" or "front-and-back" motion along bottom side (20*b*) of top plate (20). Moreover, it can be seen that such for and aft movement of sliding plate (36) is initiated by the movement of closure plates (16) from its normally closed position. That is, sliding plate bias mounts (56*a*) and (56*b*) separated by spring bias (58) press against mounting plate (52) mounted rollers (54) and against rear surface (16*b*) of closure plate (16). It is this means, referenced earlier, that maintains closure plate (16) in a normally closed position. More particularly, it can be seen that sliding plate bias mounts (56*b*) are integral with the sliding plate and an urge sliding plate (36) with its integral mount plates (52) and rollers (54) against the rear surface (16*b*) of closure plate (16).

At this point in our discussion of theft deterrent device (10) we have seen that there is a means for urging closure plate to a closed position and a means for locking and unlocking closure plate (16) into such a closed position, such lock/unlock means engaged by the door opening of the newspaper cabinet. What is needed is a means for arming locking pin (32) and disarming locking pin (32). The details of such means will be more appreciated with referenced to FIGS. 1, 2, 3, and 6.

Upon door closure, engagement finger (28*a*) is pressed downward raising locking pin (32) out of hole (34). Of course, as the door is being closed, the purchased newspaper has already been removed and enclosure plate (16) is in a closed position with hole (34) aligned beneath locking pin (32).

Figure 4:
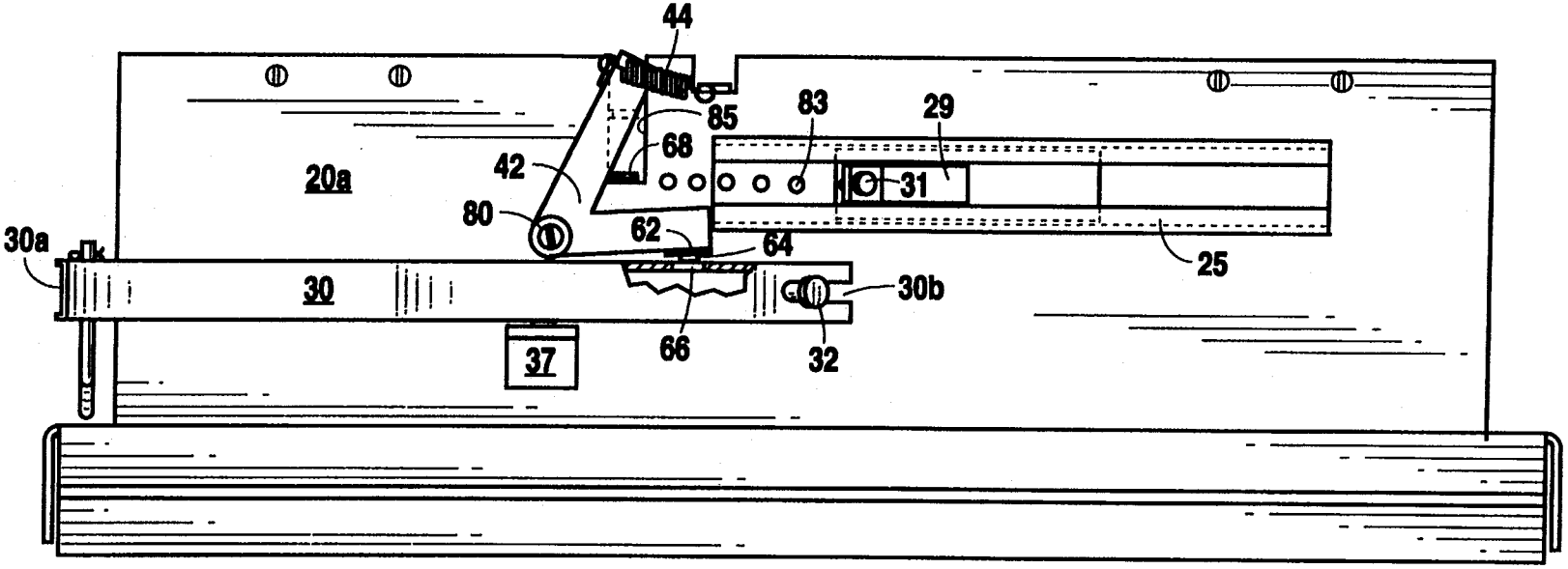
FIG. 4 is a top planform view of the theft deterrent device
Figure 6:
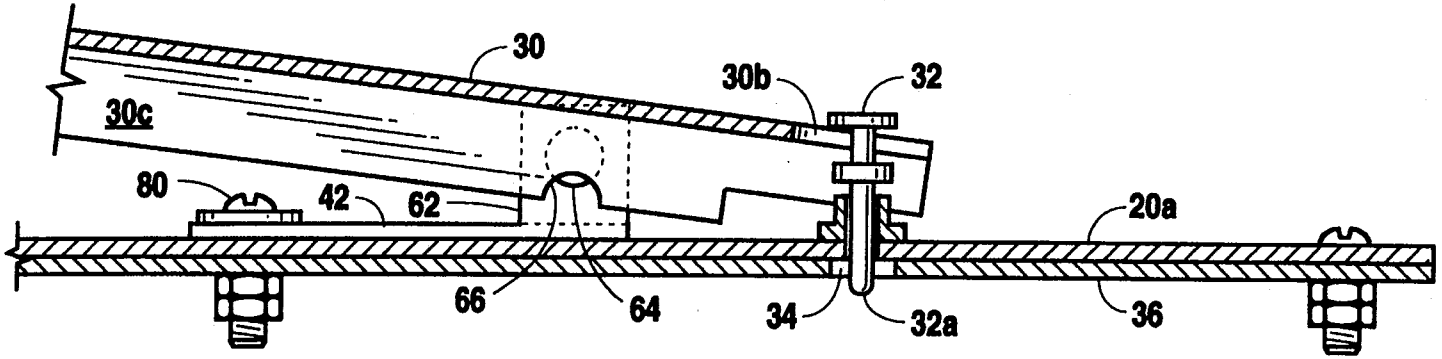
FIG. 6 is a side elevational view, and cutaway, of the resettable locking pin feature of the theft deterrent device removed from the remainder of the device.
Figure 5:
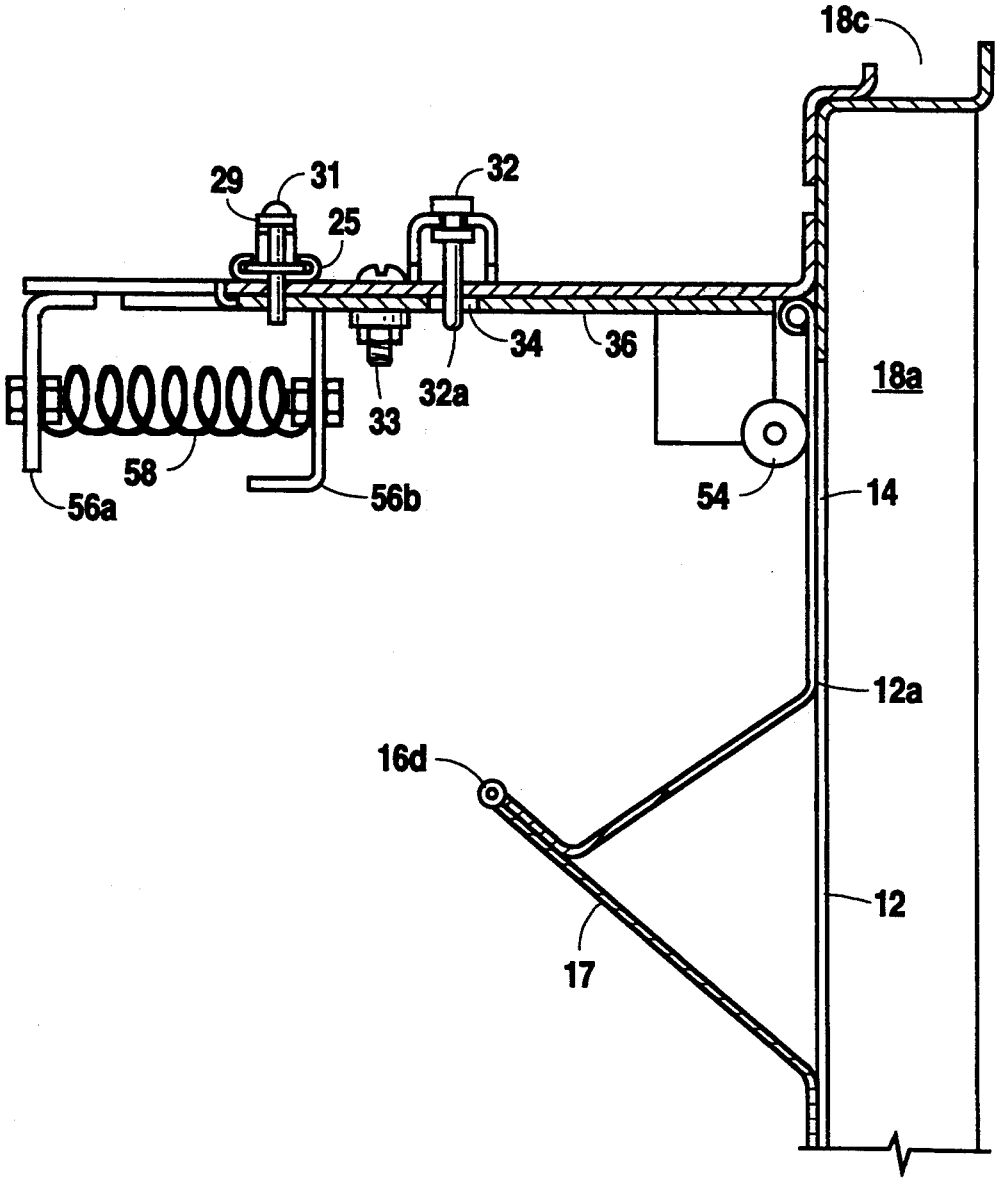
FIG. 5 is a side elevational view and cutaway of the upper portion of the theft deterrent device.

Reference to FIGS. 4, 5 and 6 more clearly illustrates the locking pin reset method. Generally V-shaped reset arm (42) engages both sliding plate (36) at engagement finger (68) and pin engagement arm (30) at locking pin (64) located on mounting arm (62) of reset arm (42). This can be more particularly appreciated in FIG. 6, where reset locking lip (66) on engagement arm (30) is dimensioned to engaging reset locking pin (64). Spring (44) biases reset arm (42) against wall (30*c*) of engagement arm (30). As slotted end (30*b*) of engagement arm (30) is raised, such as upon closing of the door of the newspaper vending machine, actuator engagement arm (28) moves downward and pin (32) will be lifted from hole (34). When pin engagement arm (30) is lifted high enough for the removed end (32*a*) of pin (32) to clear a hole (34), reset locking lip (66) will engage the upper perimeter of reset locking pin (64), thereby preventing slotted end (30*b*), normally bias downwardly, by spring (46*a*), from falling. Thus, this is the condition of theft deterrent device (10) when the next consumer opens the door. That is, the locking pin reset mechanism is in a "loaded condition," ready to reset the locking pin.

Engagement finger (68) is an upwardly projecting integral extension of sliding plate (36), passing through groove (85) in top plate (20). As the consumer begins to withdraw the paper through the closure plate the sliding action of rollers (54) move sliding plate (36) rearward, allowing engagement finger (68) to act on and pivot reset arm (42) about pivot (80) (See FIG. 1). This action disengages locking pin (64) from resetting locking lip (66) allowing normally biased pin engagement arm to shift downward at slotted end (30*b*). However, removed end (32*a*) of locking pin (32) will now be riding on the topside of sliding plate (36) as the closure plate opens and begins to close. However, following withdrawal of the newspaper, closure plate (16) moves to the normally biased closed position. Removed end (32*a*) of locking pin will then fall in hole (34) locking sliding plate (36) in place such that rollers (54) block opening of closure plate (16) until door (25*a*) of the vending machine is closed. Thus, it is seen how there are means for setting and resetting locking pin (32) thereby allowing access through T-shaped opening (14).

It remains to be seen, in the following section of the specifications, the manner in which the width of the opening created by pivoting the closure plate may be varied so as to be narrow for the thin daily editions of the newspapers but to be wider for the thicker editions, such as the Sunday editions of the newspaper. What is desired is a means to simply and quickly and adjustably provide for a variety of opening distances between top edge (12*a*) of front panel (12) and leading edge (16*c*) of closure plate (16). Reference to FIGS. 1, 2, 4, and 5 provides an illustration of such a means for width opening adjustment. More specifically, width adjustment means may be seen to include a series of linearly-aligned adjustment holes (83) bored through top plate (20). Aligned with adjustment holes (83) is slide (25) in which rides pin retainer member (29) with closure setting pin (31) slidably engaged therewith. Closure setting pin (31) is free to move up and down within pin retainer member (29). Pin retainer member (29) slides linearly within slide (25) with the pin aligned along the axis of width adjustment holes (83).

Alternate Preferred Embodiments

Figure 1A:
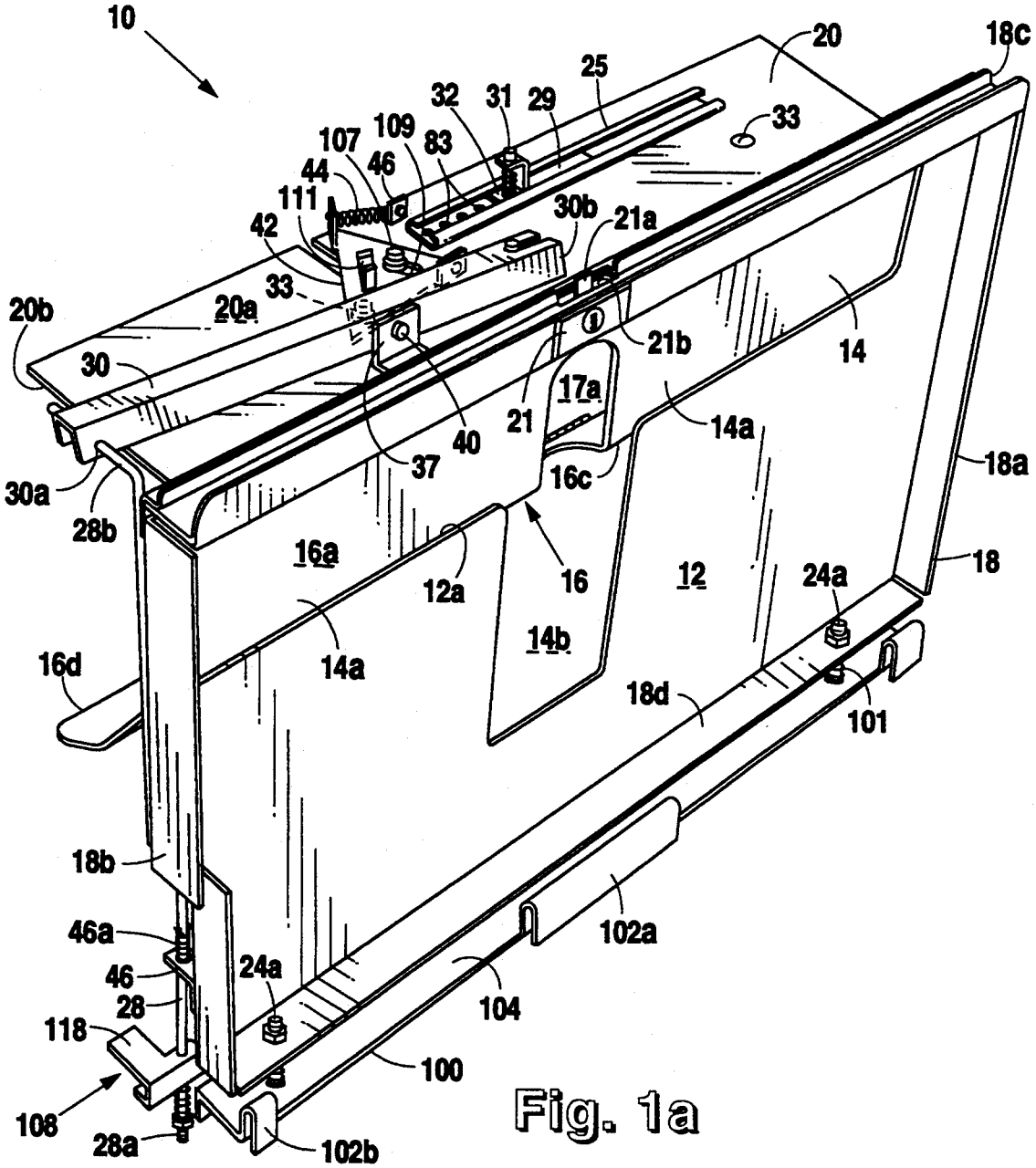
FIG. 1*a* is a prospective view of an alternate preferred embodiment of the present invention, featuring a bracket, a modified reset arm and a modified engagement finger.

FIG. 1*a* discloses an alternate preferred embodiment of applicants' theft deterrent device (10), the alternate preferred embodiment providing a functional substitute for channel (22), also a modification to reset arm (42), and engagement finger (28*a*).

Figure 1B:
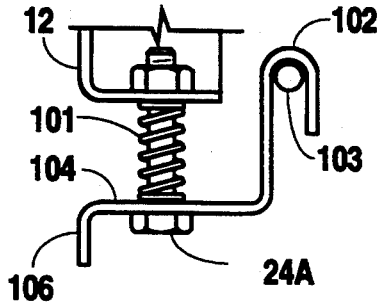
FIG. 1*b* is a side elevational view of the bracket of the alternate preferred embodiment illustrated in FIG. 1*a*
Figure 1C:
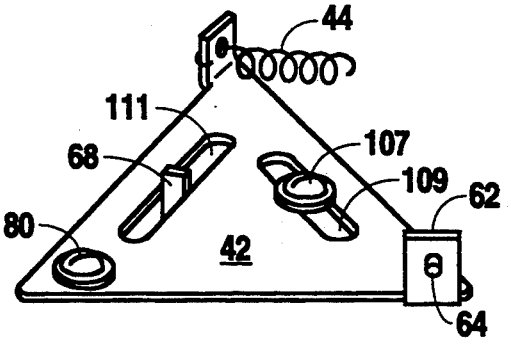
FIG. 1*c* is a top elevational view of an alternate preferred embodiment of applicants' device showing reset arm apart from the device and having a guide slot therein.
Figure 1D:
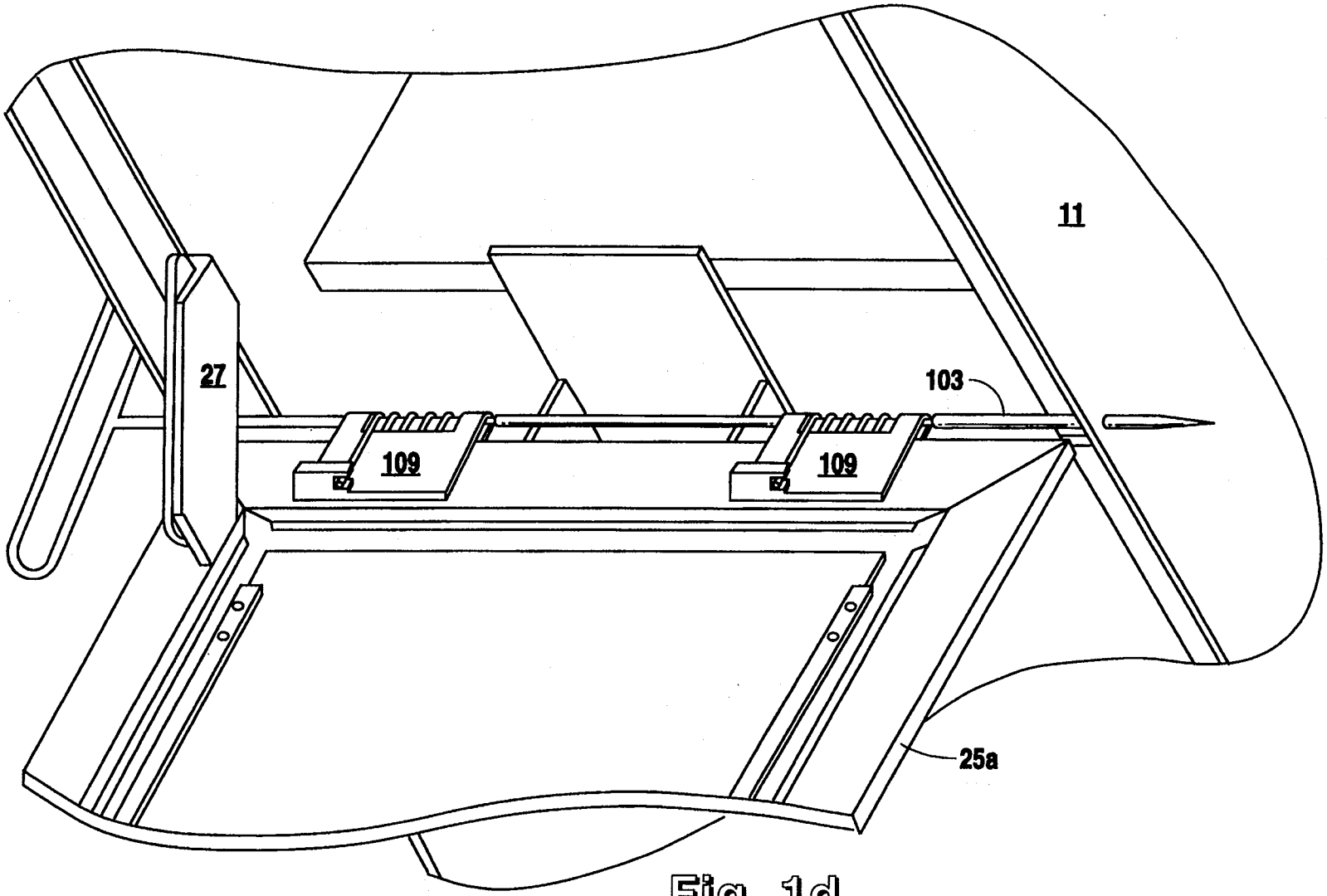
FIG. 1*d* is a perspective view of the open door of the cabinet of the newspaper vending machine.

Turning now to FIGS. 1*a*, 1*b* and 1*d*, on lower edge (18*d*) it is seen that attached to and appending below lower edge (18*d*) is bracket (100). Bracket (100) is mounted on guide means (24*a*) here illustrated as the nut-and-bolt combination (FIG. 1*b*) and biased away from lower edge (18*d*) on coil springs or bias means (101). Bracket (100) has a U-shaped channel portion (102) located centrally and at removed ends as illustrated as elements (102*a*) (central) and (102*b*) (ends) (FIG. 1*d*). Channel portions (102*a*) and (102*b*) are dimensioned to accept hinge bar (103) of the door of the cabinet, between hinges (109). Bracket (100) is seen to have a base (104) and a depending lip (106). Thus, the use of bracket (100) allows the technician to install theft deterrent device (10) by using coupling means (22*a*), coupling channel portions (102*a*) and (102*b*) over door hinge bar (103). Compression between bracket (100) and lower edge (18*d*) allows the technician to rotate theft deterrent device (10), now hooked to hinge bar (103), into the opening provided for in the door cabinet, coupling it to the top edge of the opening of the door cabinet as illustrated in FIG. 3. Lock means (21) then allows the technician to secure theft deterrent device (10) into the opening provided for in cabinet (11).

Viewing now FIG. 1*a* in conjunction with FIG. 1*c*, it is seen that reset arm (42) may be modified such that engagement finger (68) rides in guide slot (111). In addition, providing for a second guide slot (109) riding on guide slot means such as nut-and-bolt (107), reset arm (42) may be provided with a more secure, inflexible plane of rotation than that illustrated in the embodiment set forth in FIGS. 1 and 4 which provided for an "open" reset arm (42) whose arms could twist or lift. The embodiment illustrated in FIG. 1*c*, in particular having guide slot (109) and guide means (107), prevents such twisting as reset arm (42) is now anchored to top surface (20*a*) of top plate (20) at two points: (80) and (107). Functionally, the two embodiments of reset arm (42) are the same.

Turning now to FIG. 2, it can be seen that sliding plate (36) has a void (48) cut therein. More particularly, it can be seen in FIG. 2 that sliding plate (36) has pin engagement edge (50) aligned on an oblique angle with the alignment of adjustment holes (83). Thus, by removing closure setting pin (31) from one adjustment hole (83) and sliding pin retainer means (29) in slide (25), closure setting pin (31) may be inserted into any one of the several adjustment holes (83). It can be seen from FIG. 2 that if closure setting pin (31) is set in a hole to be right or near the end of the line of adjustment holes, pin engagement edge (50) will strike pin sooner rather than later. When closure setting pin (31) makes contact with pin engagement edge (50), closure plate (16) can move no further rearward or back, and can only move forward or towards the closed position. Thus, closure setting pin (31) can be set in the furthest adjustment hole to the left as viewed in FIG. 2 for the thickest editions of the newspaper. The series of multiple adjustment holes (83) allows the operator to set an appropriate closure setting width for a multiplicity of sizes of newspapers.

Figure 2B:
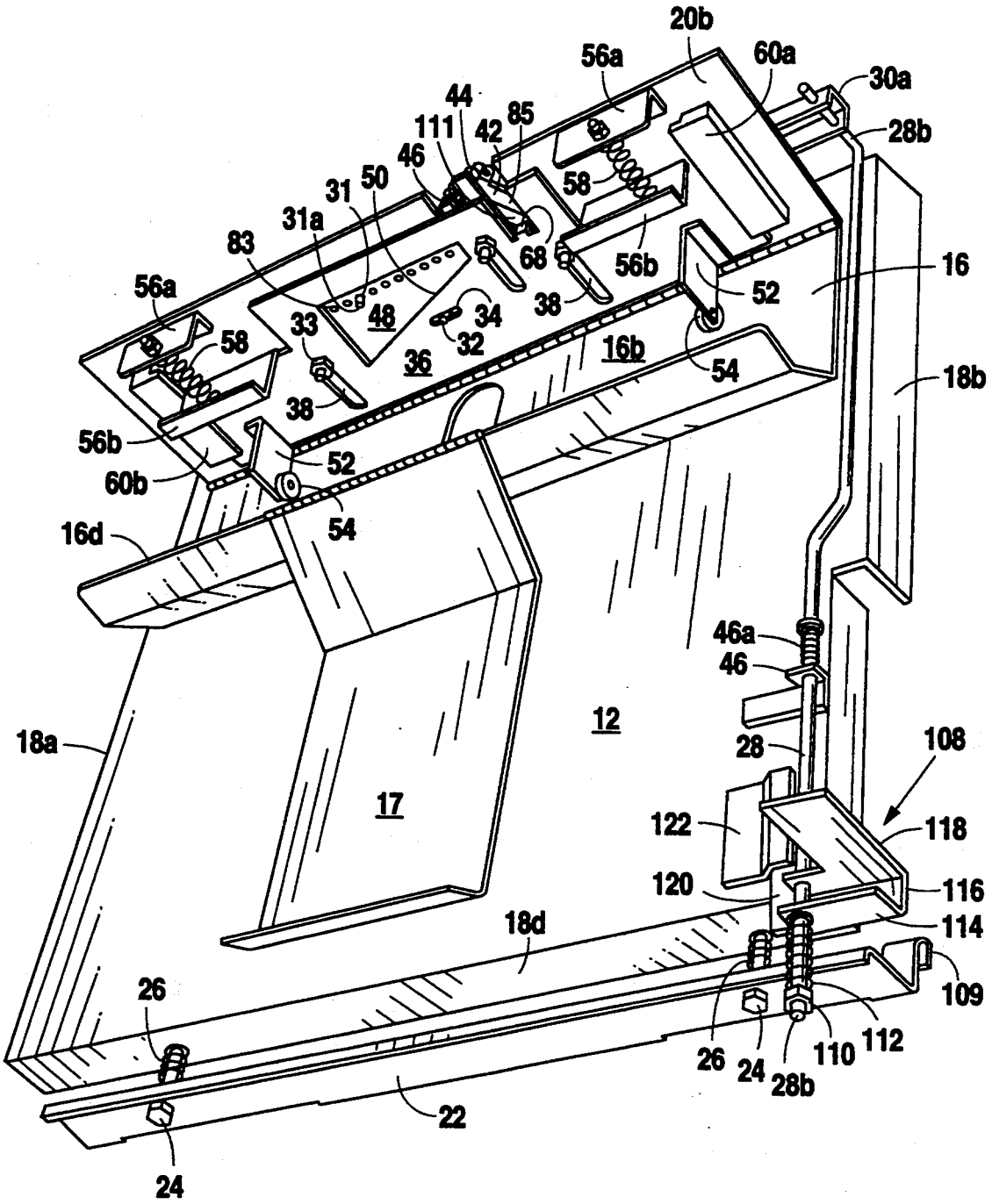
FIG. 2*b* is an alternate preferred embodiment of applicants' device.

Turning now to FIG. 2*b*, a preferred alternate embodiment is provided to replace or modify engagement finger (28*a*) of actuator engagement arm (28). FIG. 2*b* illustrates door engagement means (108) which is functionally identical to engagement finger (28*a*) but provides for a more stable engagement of device (10) with door. Engagement means (108) is seen to include a J-shaped bracket (109) secured to removed end (28*b*) of actuator engagement arm (28) with nut (110). Bias means (112) such as the coil spring illustrated in FIG. 2*b*, biases J-shaped bracket against underside of lower edge (18*d*). J-shaped bracket (109) is seen to have a short leg (114), a base (116), and a long leg (118). Bias means (112) urges short leg (114) upward so the bracket rests against lower edge (18*d*). Long leg (118) has a perpendicular blade (112) extending from the surface thereof to engage blade guide (122) affixed to rear surface (12) of theft deterrent device (10). Use of door engagement means (108) as provided for and illustrated in FIG. 2*b* allows for a more secure engagement of door actuator member (27) of door (25*a*). Door actuator member (27) engages upper leg (118) of J-shaped bracket (109) as the door closes to depress actuator engagement arm (28) and function as otherwise described above (i.e., as does engagement finger (28*a*)). Although the use of engagement means (108) as illustrated in FIG. 2*b* provides for some additional complexity as compared to engagement finger (28*a*), the use of guide means as provided for by blade (112) and blade guide (122), as well as the increased structural integrity of the J-shaped outline of bracket (109) provides for more secure engagement with door (25*a*).

Thus it can be seen that the present application discloses a device for retrofit into the cabinets of newspaper vending machine racks to prevent the removal of more than one copy of the newspaper for each vend or door opening of the cabinet. The single vend device of the present invention consists of a front panel with a T-slot. The arms of the T-slot are normally closed off with a pivoted closure plate. Consumer access to the newspapers is provided through the leg of the T-slot, but the newspaper must be slid through the gap between the closure plate and the front panel. The thickness of the gap is adjustable to selectively allow for the variation in thickness between various editions of the newspaper. The closure plate is spring loaded to be bias to a closed position. Following removal of the paper, the closure of the plate and a locking pin prevents the plate from re-opening. The locking pin is disarmed upon closure of the cabinet door.

Additional Alternate Preferred Embodiments

Lockable perimeter engagement means of the prior embodiments have utilized elements separate from the front panel such as channel (22) as seen in FIG. 1 and bracket (100) as seen in FIG. 1*a*. Here, applicants simplify the previous embodiments by omitting numerous elements including (22), (24), (26), (18*c*) of the previous embodiments and instead providing two lips integral with the perimeter of front panel (12) which, when utilized properly and in conjunction with perimeter walls of cabinet (11) and locking key member (21) having blade (21*a*), will securely affix device (10) within the newspaper cabinet. More particularly, and in reference to FIGS. 7 and 8, in place of the foregoing elements, applicants have left remaining top edge (200) of front panel (12) as seen in FIGS. 1, 1*a* and 3 and eliminated top edge lip (18*c*) as seen in FIG. 1. Along lower edge (18*d*) of perimeter (18) of front panel (12) is support port member (202) trending perpendicular to the plane of front panel (12). Support member (202) has a curved leading edge (204) which will engage hinge bar (103) as seen in FIG. 1*b*. That is, to install the single vending device (10) having support member (202), the vendor rotates blade (21*a*) to a down position then places curved leading edge (204) over hinge box (103) and rotates the device into place in the cabinet until top edge (200) is flush against lip (11*a*) of the cabinet. Then, by rotating blade (21*a*) to the up or locked position (see FIG. 1) so the blade is behind lip (11*a*), the vendor has secured the device into the newspaper cabinet. Thus, applicants have reduced the number of elements required to provide secure locking engagement between device (10) and cabinet (11) without sacrificing the integrity and safety of the unit.

Figure 7:
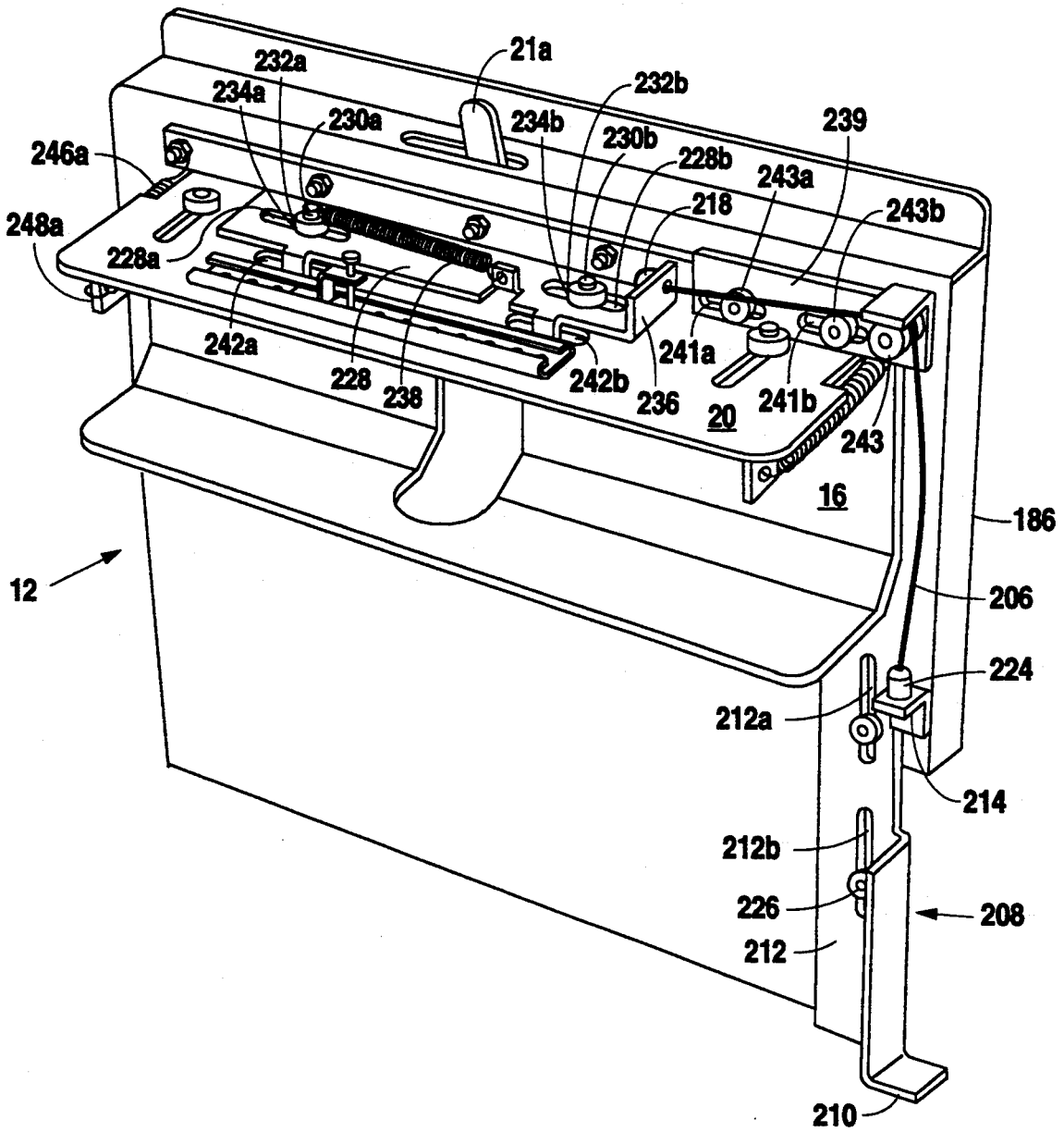
FIG. 7 is a rear perspective view of Applicants' present invention showing the top side of the mounting plate.
Figure 8:
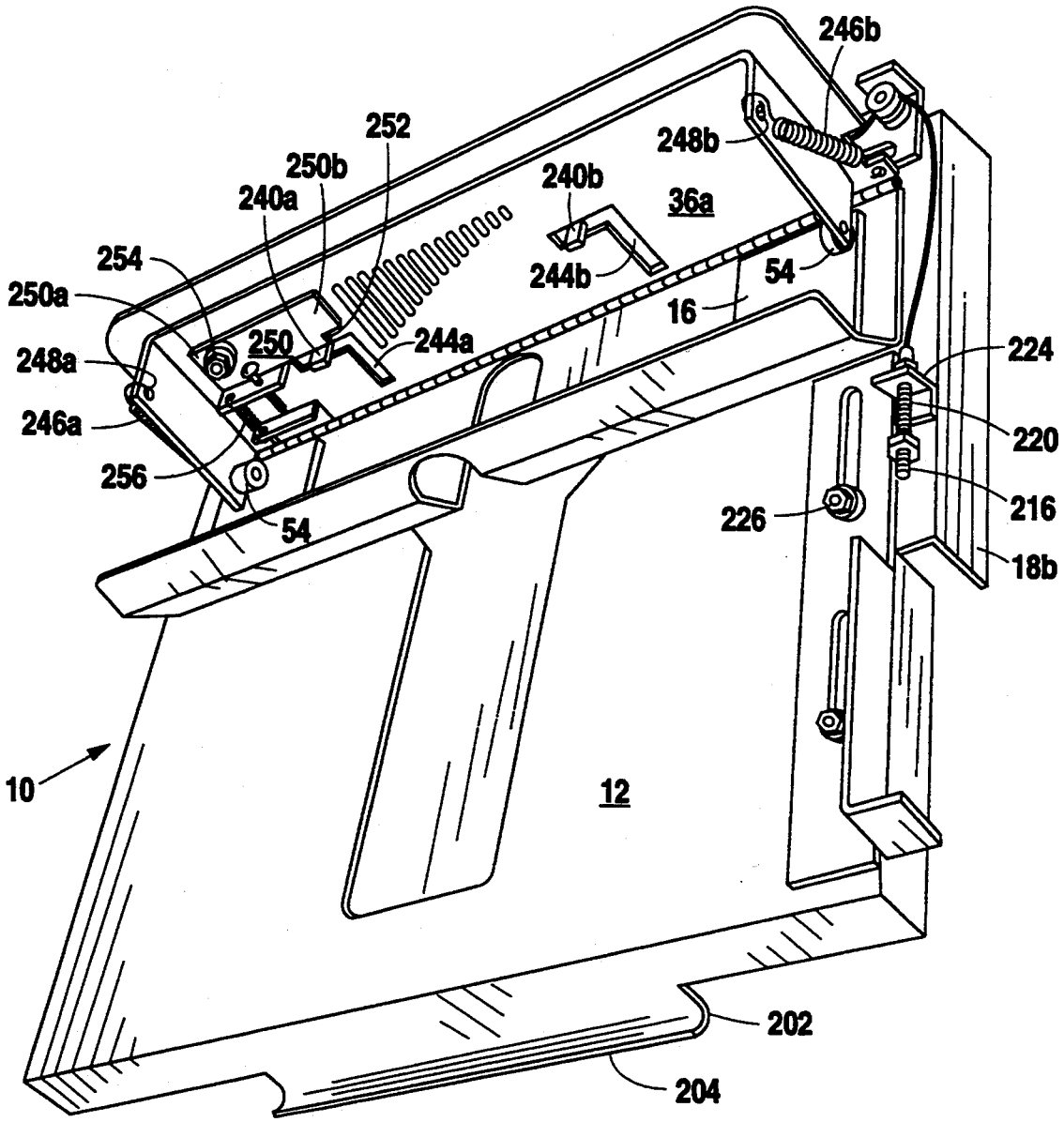
FIG. 8 is a rear perspective view of Applicants' present invention showing the sliding plate and the closure plate in a locked, closed position.

FIGS. 7 and 8 illustrate applicants' use of a cable (206) as part of resettable lock means for closure plate (16). More specifically, FIG. 7 illustrates cable (206) engaging a coupling bracket (208). Coupling bracket (208) is made up of a number of portions including a door engagement member (210), a slotted member (212) with slots (212*a*) and (212*b*) therein and a cable attachment member (214). With reference to cable (206), it is seen that cable (206) has a swaged near end (216) at coupling bracket (208) and a swaged removed end (218). At near end (216) coupling bracket (208) is provided with an adjustment means, here a bolt (220) with a longitudinal bore therethrough for threading near end (216) therethrough. Nut (224) is rigidly mounted to cable attachment member (214). Rotation of bolt (220) will adjust the slack in cable (206). More specifically, as illustrated in FIG. 8, clockwise rotation of bolt (220) about rigidly mounted nut (224) will result in more slack in cable (206) whereas, a counter-clockwise rotation will result in less slack.

It is seen then how slotted member (212) has walls defining slots (212*a*) and (212*b*) therein. These walls, in conjunction with attachment means (226) here a pair of nut and bolt fasteners, will maintain coupling bracket (208) positioned adjacent and flush to the rear wall of front panel (12) adjacent edge (18*b*) but, will allow coupling bracket (208) to slide up and down in slots (212*a*) and (212*b*) as door actuator member (27) of door (25*a*) strikes door engagement member (210).

Use of cable (206) helps prevent "bounce" that has been found to sometimes occur when the coupling between door (25*a*) and resettable lock means is in the form of rigid bar or rod. Moreover, it has been found that the use of cable (206) is easier to set from the factory such that it will engage door actuator members (27) where the latter have slightly different dimensions and positions with respect to coupling bracket (208) as devices (10) are mounted into various individual newspaper racks. The use of cable (206) would typically take up most of the variations and alignments that can be found between device (10) and door actuator members (27) without the need for adjustments.

Figure 9:
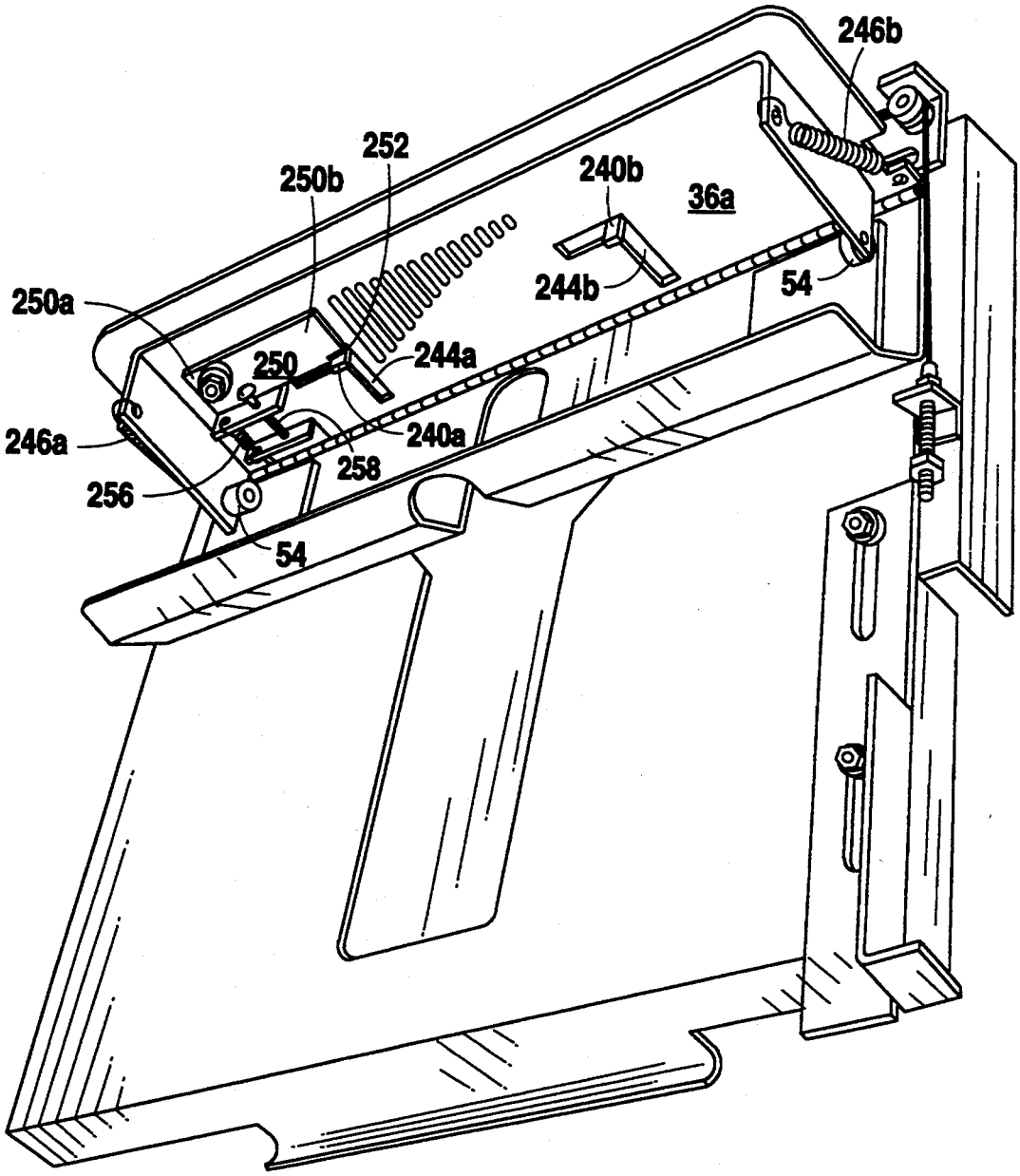
FIG. 9 is a rear perspective view of Applicants' present invention showing the closure plate in a loaded arm position and showing the underside of the sliding plate.

FIGS. 7, 8 and 9 illustrate an alternate preferred embodiment of means to resettably lock closure plate (14) in a closed position. In the previous embodiments, the closure plate lock means comprised an arm, pin means, reset means and walls defining a pair of holes, one in the mounting base, another in the sliding sheet, the holes being in alignment with the pin therethrough when the closure plate was locked in the closed position. The arm, coupled through a rod to the door of the newspaper cabinet would raise the pin out of the holes when the door was closed, thereby allowing the sliding sheet to move with respect to the top plate and allowing the closure plate to pivot. The details of this resettable lock closure plate means is set forth in the discussion above with respect to FIGS. 1 and 2.

Here, however, applicants have replaced engagement arm (28) with cable (206) in the alternate preferred embodiment set forth herein. Engagement arm (30), pin (32) and reset arm (42) as well as related elements associated therewith as more specifically set forth in FIGS. 1 and 2 above are replaced with the following structure which has simplified the use, adjustment and manufacture of the resettable locking means. More specifically, applicants' device as illustrated in FIG. 7 is seen to have slidably mounted to top plate (20) an "L-shaped" sliding member (228) having walls defining alignment slots (228*a*) and (228*b*). Sliding member (228) rides on guide posts (230*a*) and (320*b*) mounted to top plate (20). The use of nuts (232*a*) and (232*b*) on guide posts (230*a*) and (230*b*) along with washer bushings (234*a*) and (234*b*) maintain sliding alignment of sliding member (228) as set forth more specifically herein. Sliding member (228) is seen to have lip (236) for engaging swaged removed end (218) of cable (206). Bias means, here spring (238) urges sliding member (228) to be left as illustrated in FIG. 7 and takes up some of the slack of cable (206).

It is also seen in FIG. 7 how sliding plate (239) having walls defining slots (241*a*) and (240*b*) for sliding past anchor guides (243*a*) and (243*b*) which are rigidly attached to the rear wall of panel (12) will allow rotatably mounted pulley (243) to route cable (206) from a vertical position for engaging sliding member (208) to a horizontal position for engaging lip (236). Here, anchors (243*a*) and (243*b*) are bolts threaded into appropriately sized nuts anchored to the rear of front plate (12) such that sliding plate (239) may be adjusted to the left or right as seen in FIG. 7 and thus, loosen or tighten somewhat cable (206).

It is seen in FIGS. 8 and 98 how locking prongs (240*a*) and (240*b*) of sliding member (228) project vertically downward through slots (242*a*) and (242*b*) in top plate (20). With reference to FIGS. 7 and 8, it is seen that prongs (240*a*) and (240*b*) project through the mounting plate and through two L-shaped channels (244*a*) and (244*b*) in sliding plate (36*a*). Observing how bias means, here springs (246*a*) and (246*b*), engage tabs (248*a*) and (248*b*) of sliding plate (36*a*) and engage top plate (20*a*), it is seen that sliding plate (20*a*) through rollers (54) is normally urged against closure plate (16) to maintain the closure plate in a closed position with respect to access slot (14). Second, it is seen that spring (238) will normally urge prongs (240*a*) and (240*b*) to the left as indicated in FIGS. 8 and 9. The combined effect of springs (246*a*) and (246*b*) and spring (238) is to normally urge prongs (240*a*) and (240*b*) in the "foot" portion of L-shaped channels (244*a*) and (244*b*) as indicated in FIG. 8.

At this point, we return to additional structure of applicants' alternate preferred embodiment, which in conjunction with the elements set forth in FIGS. 7, 8 and 9 above, provide applicants with the means of simply and effectively unlocking a locked closed closure plate when the door of the vending machine is shut and which further provides a means for rearming the lock following movement of the closure plate such that upon the return of the closure plate to a closed position, it is locked until the door of the newspaper vending machine is closed. Thus, applicants have provided an alternate to resetting arm (42) and the elements associated therewith as set forth more particularly with reference to FIGS. 1 and 2 above.

Specifically, applicants provide for pivoting trip lever (250) mounted to the underside of sliding plate (36*a*). More specifically, with reference to FIGS. 8 and 9, it is seen that the trip lever has a first end (250*a*) pivotly mounted to the sliding plate and a second end (250*b*) removed from first end and having a notch (252) therein. Trip lever (250) is rotatably mounted to the underside of the sliding plate on fastener (254). Spring (256) urges second end (250*b*) of trip lever (250) toward a normally closed position covering or obscuring the foot portion of L-shaped channel (244*a*). It is further seen how trip lever (250) may be adjustably located through the use of screw adjustment (258) which can control the position of trip lever (250) about fastener (254) and also with respect to locking prong (240*a*).

Turning now to the operation of the resettable locking means of this alternate preferred embodiment, let us examine the condition of the locking means with the door of the cabinet shut. With the door of the cabinet shut, slotted member (212) has been urged down by the action of the closing of the door. When slotted member (212) was pushed down, cable (206) was tightened and urged sliding member (228) to the right as illustrated in FIG. 7. Prongs (240*a*) and (240*b*) being integral with sliding member 228 slid through the right as illustrated in FIGS. 8 and 9 in channels (244*a*) and (244*b*). When prong (240*a*) slid to the right, it slid along the lower edge of trip lever (250) which was biased against prong (240*a*) by spring (256). The walls of channels (244*a*) and (244*b*) will prevent additional movement of sliding plate (228) to the right. The walls of notch (252) lock prong (240*a*) and sliding plate (228) against moving to the left under the urging of spring (256). In this condition, resettable locking means is unloaded and closure plate (16) may be pivoted away from the opening and will provide access to the newspaper.

The consumer opens the door of the newspaper vending machine to find the closure plate in this unlocked condition as illustrated in FIG. 9. However, reaching through the closure plate and withdrawing the newspaper from the horizontal slot requires movement of the closure plate towards an open position. The action of pivoting the closure plate towards an open position will cause sliding plate (36*a*), through rollers (54) to begin to slide. As prong (240*a*) slides in the leg portion of channel (244*a*), trip lever (250) will move, under the urging of spring (256) into a position occluding the foot portion of channel (244*a*).

As prong (240*a*) returns to the foot portion of the L-shaped channel as the closure plate moves into the closed position under the urging of springs (246*a*) and (246*b*), it will lift second end (250*b*) up and will slide, under the urging of spring (238) into the foot portion of L-shaped channel (244*a*) and any attempt at opening the closure plate with the locking prong in this condition (see FIG. 8) will be met with interference between prongs (244*a*) and (244*b*) with the walls defining the foot portions of channels (244*a*) and (244*b*).

Terms such as "left," "right, " "up " "down," "bottom," "top," "front," "back," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A theft deterrent device for newspaper vending machine, the vending machine having a cabinet with walls defining a door opening, the cabinet for enclosing newspapers, and having a pivotly mounted, hinge operated door to provide access to the interior of said cabinet, a means for lockingly engaging said door to the cabinet, and a coin control mechanism to activate and deactivate the locking means, said theft deterrent device comprising:

a front panel with a front and rear surface, for substantially blocking access to the newspapers, said front panel having a perimeter dimensioned to engage the walls defining the door opening of the cabinet of said newspaper vending machine, said front panel having walls defining an opening, the opening being of sufficient size to extract a newspaper therefrom;

movable means to selectively block in a closed position, and unblock in an open position, the opening of said front panel;

resettable locking means capable of locking and unlocking said movable means in a closed position;

a cable, operatively engaged with said resettable locking means and capable of engagement with the door of the newspaper vending machine for unlocking said resettable locking means upon engagement with a door.

2. A device of claim 1, wherein resettable locking means includes a locking prong engaging said cable for moving out of locking engagement with said closure plate when said cable is engaged by said door.

3. A device of claim 1 further including a sliding plate engaged to move with said moveable means; and a mounting plate vertically extending from the rear surface of said front panel, wherein said resettable locking means includes a locking prong mounted to move upon actuation of said cable and a trip lever pivotly mounted to move with said movable means, said trip lever pivotly mounted to said sliding plate, wherein the sliding plate has walls defining a channel for riding past the locking prong and the trip lever is capable of engaging and disengaging the trip lever to lock and unlock the closure plate.

4. A device of claim 1 wherein said front panel has walls defining a lower edge and integral with a lip member projecting generally perpendicular from the plane of said front panel for engaging a hinge bar of the door of the cabinet.

5. A device of claim 1, wherein resettable locking means includes a locking prong engaging said cable for moving out of locking engagement with said closure plate when said cable is engaged by said door, and wherein said front panel has walls defining a lower edge and integral with a lip member projecting generally perpendicular from the plane of said front panel for engaging a hinge bar of the door of the cabinet.

6. A device of claim 1 further including a sliding plate engaged to move with said moveable means;

a mounting plate vertically extending from the rear surface of said front panel, wherein said resettable locking means includes a locking prong mounted to move upon actuation of said cable and a trip lever pivotly mounted to move with said movable means, said trip lever pivotly mounted to said sliding plate, wherein the sliding plate has walls defining a channel for riding past the locking prong and the trip lever is capable of engaging and disengaging the trip lever to lock and unlock the closure plate; and wherein said front panel has walls defining a lower edge and integral with a lip member projecting generally perpendicular from the plane of said front panel for engaging a hinge bar of the door of the cabinet.

7. A device of claim 1, wherein resettable locking means includes a locking prong engaging said cable for moving out of locking engagement with said closure plate when said cable is engaged by said door; a sliding plate engaged to move with said moveable means;

a mounting plate vertically extending from the rear surface of said front panel, wherein said resettable locking means includes a locking prong mounted to move upon actuation of said cable and a trip lever pivotly mounted to move with said movable means, said trip lever pivotly mounted to said sliding plate, wherein the sliding plate has walls defining a channel for riding past the locking prong and the trip lever is capable of engaging and disengaging the trip lever to lock and unlock the closure plate; and wherein said front panel has walls defining a lower edge and integral with a lip member projecting generally perpendicular from the plane of said front panel for engaging a hinge bar of the door of the cabinet.

* * * * *